US005328319A

United States Patent [19]

Fadaie

[11] Patent Number: 5,328,319

[45] Date of Patent: Jul. 12, 1994

[54] ROBOTIC SYSTEM FOR MIXING AND PACKING ARTICLES

[75] Inventor: Saadat Fadaie, Antioch, Calif.

[73] Assignee: James River Paper Company, Inc., Richmond, Va.

[21] Appl. No.: 944,351

[22] Filed: Sep. 14, 1992

[51] Int. Cl.[5] ..... B65B 5/06

[52] U.S. Cl. ..... 414/416; 414/411; 414/741; 294/87.1; 53/237; 53/238; 901/39

[58] Field of Search ..... 414/403, 404, 411, 623, 414/741, 744.3, 416, 626; 901/39; 294/87.1; 53/155, 237, 238, 539, 250, 240

[56] References Cited

U.S. PATENT DOCUMENTS

| | | | |
|---|---|---|---|
| 3,983,373 | 9/1976 | Russell . | |
| 4,132,319 | 1/1979 | Padovani | 294/87.1 X |
| 4,239,432 | 12/1980 | Richardson . | |
| 4,316,694 | 2/1982 | Martin | 294/87.1 X |
| 4,677,808 | 7/1987 | Chenevard | 53/238 |
| 4,684,307 | 8/1987 | Lattion et al. . | |
| 4,692,876 | 9/1987 | Tenma et al. . | |
| 4,735,452 | 4/1988 | Nemoto . | |
| 4,744,595 | 5/1988 | Tonning et al. . | |
| 4,832,180 | 5/1989 | Ferrero | 294/87.1 X |
| 4,856,263 | 8/1989 | Schneider et al. . | |
| 4,976,584 | 12/1990 | Focke . | |
| 4,986,726 | 1/1991 | Benuzzi et al. . | |

*Primary Examiner*—Michael S. Huppert
*Assistant Examiner*—Stephen Gordon
*Attorney, Agent, or Firm*—Thomas R. Lampe

[57] ABSTRACT

A system for transferring articles between containers to vary the mix of articles in the containers. A plurality of containers are moved to a mixing station and apparatus including a robot removes selected articles from the containers and places them into other of the containers to provide the desired mix of articles. In the arrangement disclosed, the articles are cups and the system is employed to change the color mix of the cups in the containers.

2 Claims, 6 Drawing Sheets

FINISHED POSITION
WORK ENVELOPE, 3 CASES
READY POSITION
THE ORIGINAL CONDITION
SOLID COLOR READY FOR INDEXING
MIXED CASES 24
32
14

ROBOTIC SYSTEM FOR MIXING AND PACKING ARTICLES

TECHNICAL FIELD

This invention relates to a method and apparatus for changing the mix of articles in a plurality of containers. The embodiment of the invention disclosed herein is for the purpose of changing the mix of colors of drinking cups in shipping cartons.

BACKGROUND ART

Products such as molded plastic cups are often produced in large color batches; that is, it is standard practice to produce large quantities of such product in one color at a time. After a predetermined large number of articles have been produced, another large batch thereof in different colors is manufactured. For example, a large number of red drinking cups may be produced. Next, yellow cups may be manufactured in large quantities, and then green, and so on. This approach is much more efficient when mass producing such articles than attempting to mold or otherwise manufacture them in small color batches.

While economies and efficiencies in operation are obtainable when utilizing the large color batch approach, a problem in packaging of the products in shipping cartons presents itself. It is common practice to package plastic cups and the like immediately after production, the packaging operation including loading the cups or the like into shipping cartons or containers. In other words, the cartons will be filled with articles of a single color. Hundreds, if not thousands, of containers will be so filled in each batch process. Thus, the end result of such an approach is that the manufacturer has produced large quantities of shipping containers filled with articles such as cups of a uniform color.

Often, however, the customers buying such products wish to have a variety of colors in a single carton. In order to satisfy this desire, it has been standard practice to assemble together a number of cartons, each of which contains articles of a single color differing from the color of those in the other cartons. Employees then manually remove a predetermined number of the cups in any one carton and replace them with cups from one or more other cartons so that a desired color mix is obtained. This procedure is inefficient, time consuming and expensive. Furthermore, employees soon find a repetitive task of this nature to be boring, making an inherently inefficient operation even more so. The likelihood of mistakes being made also increases over time, which means that the color mix of the cartons or containers may not be that desired.

A search of the prior art located the following U.S. Pat. Nos.: 4,856,263, issued Aug. 15, 1989, 4,239,432, issued Dec. 16, 1980, 4,197,046, issued Apr. 8, 1980, 4,684,307, issued Aug. 4, 1987, 3,983,373, issued Sept. 28, 1976, 4,692,876, issued Sept. 8, 1987, 4,735,452, issued Apr. 5, 1988, 4,744,595, issued May 17, 1988, 4,976,584, issued Dec. 11, 1990, and 4,986,726, issued Jan. 22, 1991.

The above-identified patents disclose various article handling and/or packaging arrangements for a wide variety of products. None of the devices in this prior art, however, concern themselves with, or are appropriate for, the efficient automatic repackaging of articles in containers in order to modify the mix of articles therein so that an accumulation of articles having different predetermined characteristics is established in each container of a group thereof.

DISCLOSURE OF INVENTION

The present invention is directed to apparatus for transferring articles having predetermined physical characteristics between containers for said articles to vary the mix of the articles in the containers whereby each of the containers will hold articles having different predetermined characteristics, such as different colors. Each container defines an interior for accommodating a plurality of the articles and an opening communicating with the interior.

The apparatus includes robot means including at least one movable robotic arm. Article engaging means is operatively associated with the at least one movable robotic arm and movable therewith for engaging a plurality of articles in the interiors of each of at least two of the containers through the openings of the containers.

The article engaging means and robot means cooperate to remove the engaged plurality of articles from their respective containers, transport the removed articles, and insert the removed articles into the interiors of predetermined containers other than the respective containers from which the articles were removed.

The article engaging means includes clamping means for clamping a plurality of the articles in each of the at least two containers and for unclamping from the plurality of articles after transport thereof to the predetermined containers.

The article engaging means additionally includes article positioning means for contacting articles in the at least two containers prior to clamping of the articles by the clamping means to move the contacted articles to predetermined positions relative to the clamping means to facilitate clamping of the articles by the clamping means.

The article positioning means includes means cooperable with the contacted articles to bias the contacted articles away from the clamping means to promote separation of the plurality of articles from the clamping means after unclamping of the plurality of articles by the clamping means.

The present invention also encompasses a method of changing the mix of articles in a plurality of containers, each container accommodating a plurality of such articles.

The method includes the step of conveying a plurality of containers to a mixing station, each of the plurality of containers containing a plurality of articles having physical characteristics differing from the physical characteristics of the plurality of articles in the other of said plurality of containers at the mixing station.

While the plurality of containers are at the mixing station, a predetermined number of articles is removed from each of at least two of the plurality of containers. After the removal step, the removed articles are transported.

After the transporting step, the removed articles are inserted into containers differing from the respective containers from which the articles were removed in order to change the mix of articles in the containers in which the articles are inserted.

Other features, advantages, and objects of the present invention will become apparent with reference to the following description and accompanying drawings.

BEST MODE FOR CARRYING OUT THE INVENTION

Figure 1:
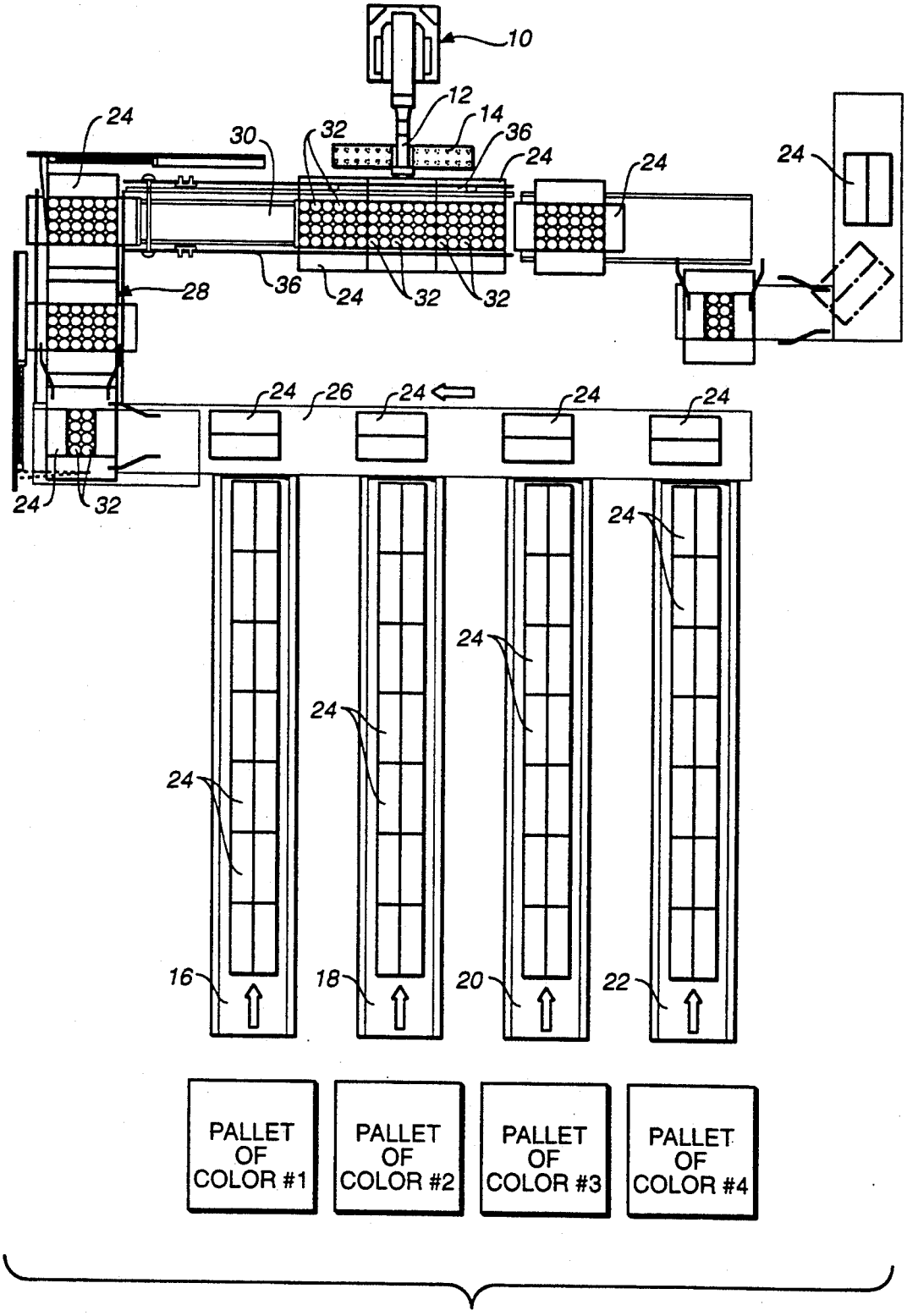
FIG. 1 is a diagrammatic, top plan view of apparatus constructed in accordance with the teachings of the present invention including a robot deployed at a mixing station operatively associated with a conveyor system for delivering containers of articles thereto.

FIG. 1 illustrates somewhat diagrammatically a typical work layout utilized when carrying out the teachings of the present invention. The layout includes a mixing station at which is located a robot 10. The robot 10 includes a robotic arm 12 having article engaging means 14 attached thereto.

The robot 10 may be of any suitable commercially available type. However, the GMF Model S-700 Robot, made available by GMFanuc Robotics Corporation of Auburn Hills, Michigan has been found to be particularly suitable for the tasks which will be described below. The GMF Model S-700 is a 6-axis articulated arm, electric servo driven robot, which may be suitably programmed to perform the tasks attributed thereto in this specification.

In the work layout shown in FIG. 1, four conveyors 16, 18, 20, 22 receive containers in the form of cartons or boxes 24 from sources such as pallets. The boxes 24 are all filled with stacks of plastic cups. All of the containers on any one conveyor are filled with cups of a single color. There are four different colors, one related to each conveyor.

The boxes 24 are discharged onto an intermediate conveyor 26. It will be appreciated that the containers are off loaded onto the intermediate conveyor in a preordained order determined by the color of the cups and the mix desired, as will be evident from the following disclosure.

Intermediate conveyor 26 transports containers 24 (which have the top flaps thereof closed in the presentation of FIG. 1) to a flap opening station 28 at which the flaps are opened (either manually or by suitable commercially available equipment) and routed to a feed conveyor 30 which moves the opened boxes to the mixing station at robot 10. When arriving at the mixing station the boxes are fully opened at the tops thereof to disclose the stacks of cups 32 within the interiors of the containers. In the arrangement illustrated, retention bars 36 are provided at the mixing station to prevent the flaps of the containers from closing.

Referring now to FIGS. 3A through 5B, details of article engaging means 14 may be seen. Article engaging means 14 includes a fixture or frame 40 attached at its midpoint by a suitable coupling 42 to the distal end of robotic arm 12. It will be seen that the fixture 40 has two sections 44, 46. Disposed along these sections in spaced relation to one another are moveable clamping elements 50. Clamping elements 50 are moveable between a non-clamping position (shown in FIGS. 3A and 5A) and a clamping position (shown in FIGS. 3B and 5B). Any suitable means, such as electric solenoids or pneumatic air cylinders may be utilized to selectively move the clamping elements between the non-clamping and clamping positions. In the arrangement shown, the clamping elements are fixed to, and dependent from, clamping element carriers 60, 62 slidably mounted on the rest of the frame and driven by air operated cylinders 64.

The article engaging means 14 includes a plurality of follower elements 52 which are slidably mounted relative to the fixture 40. More particularly, each follower element includes an elongated shaft 54 which is freely slidably disposed in an associated aperture defined by the fixture. Attached to the bottom of each shaft 54 is a tapered enlargement or follower head 56 which limits upward movement of the follower element of which it is a part. Enlargements 58 are affixed to the upper ends of shafts 54 and limit the amount of downward movement of the follower elements relative to the fixture. Preferably, the enlargements 58 are formed of relatively heavy material such as steel so that downward bias of the follower elements under the influence of gravity is enhanced.

Figure 4A:
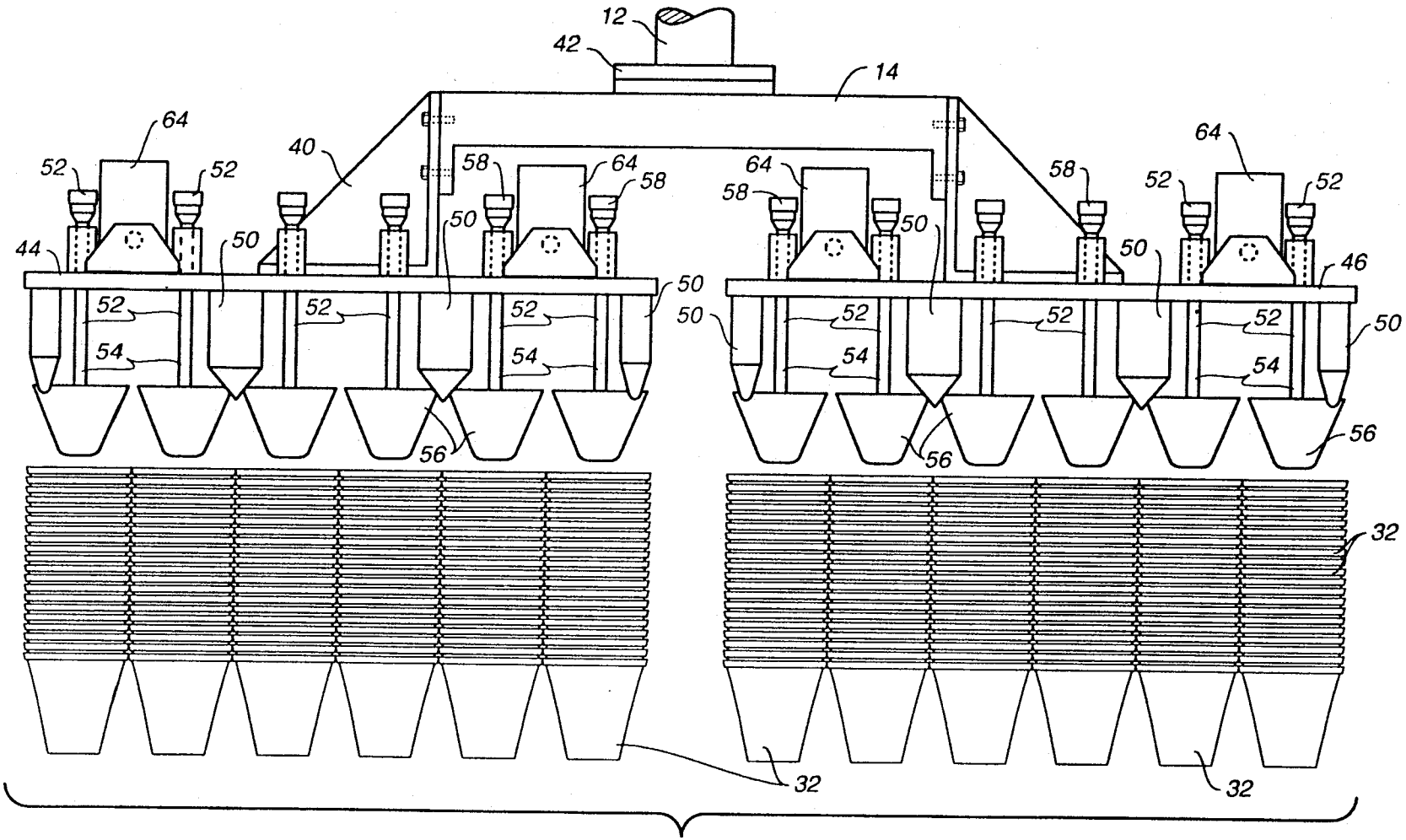
FIG. 4A is a frontal, elevational view of the article engaging means of the present invention, illustrating same closely adjacent to a plurality of cups.

In use, the article engaging means is positioned by the robot over two adjacent boxes 24 located at the mixing station. FIGS. 4A and 5A show the relative positions assumed between the article engaging means and the stacks of cups 32 in the boxes. In the interest of simplicity and clarity, the boxes or containers themselves are not shown in FIGS. 4A through 5B. Furthermore, in the actual practice of the invention it is preferred that each stack of cups be enclosed within an overwrap such as plastic sheeting so that the stacks are handled as individual packages or units during the operation of the apparatus of the present invention. Again in the interest of simplicity and clarity, such overwrap is not illustrated.

After the article engaging means 14 has been positioned as shown in FIGS. 4A and 5A, it is lowered by the robotic arm 12 so that follower heads 56 of follower elements 52 engage and enter into the top most cups of the stacks disposed thereunder. Due to the taper of the follower heads 56, the tops of the stacks will be precisely positioned relative to the fixture and clamping elements. That is, the stacks, or at least some of them, may be repositioned somewhat within their respective containers.

Figure 4B:
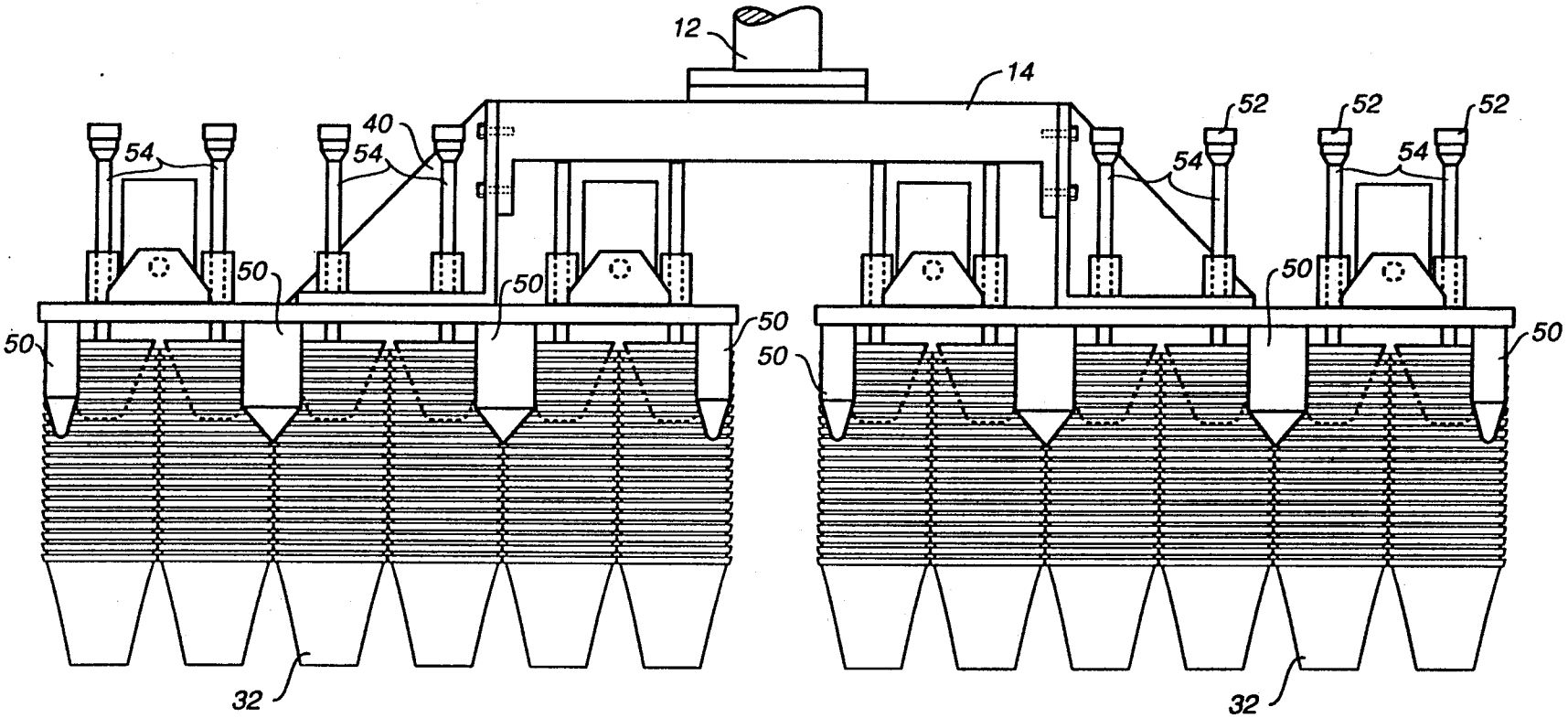
FIG. 4B is a view similar to FIG. 4A, but showing the article engagement means in engagement with the cups during clamping of same by the clamping elements of the article engaging means.

Downward movement of article engaging means 14 continues until the stacks of cups 32 and the article engaging means 14 assume the relative positions shown in FIG. 4B. It will be appreciated that up to this point the clamping elements are in their non-clamping position or condition. However, when the stacks of cups and article engaging means 14 assume the relative positions shown in FIG. 4B the clamping elements 50 are moved to their clamping positions, i.e. toward the cups engaged by follower elements 52. The clamping elements engage the cups and settle between adjacent cups.

It will also be appreciated that during downward movement of the article engaging means from the position of FIG. 4A to the position of FIG. 4B, the follower elements 52 will be stopped from further downward movement when the follower heads 56 are seated in their respective stacks. Thus, the follower elements 52 will move upwardly relative to the fixture 40 and assume the relative positions shown in FIGS. 4B and 5B. The clamping elements and follower elements cooperate to lock the engaged stacks into place relative to the article engaging means once the clamping elements have moved to their clamping positions.

Now the engaged stacks of cups are removed from their respective containers. This is accomplished simply by raising the article engaging means 14 relative to the containers to a degree sufficient to have the bottoms of the stacks of cups clear the tops of the containers.

Next, the robot and article engaging means cooperate to transport the removed stacks of cups to containers differing from the containers from which they were removed so that a desired mix of colors within any given container can be obtained. FIGS. 2A through 2D illustrate diagrammatically one approach for accomplishing such mixing.

Figures 2A, 2B, 2C, 2D:
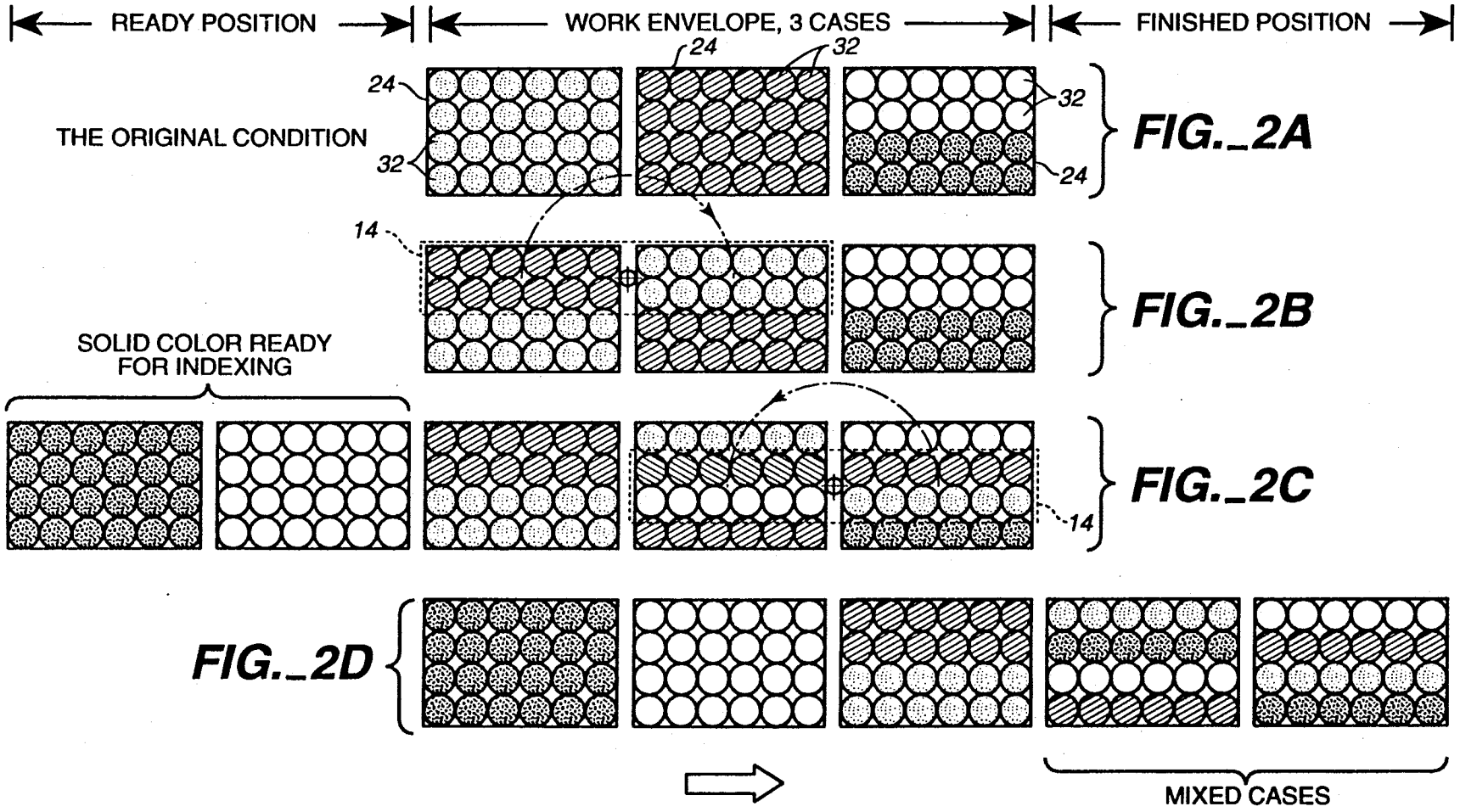
FIGS. 2A–2D are diagrammatic presentations illustrating the mix of articles in containers through utilization of the system of the present invention during sequential stages.
Figure 3A:
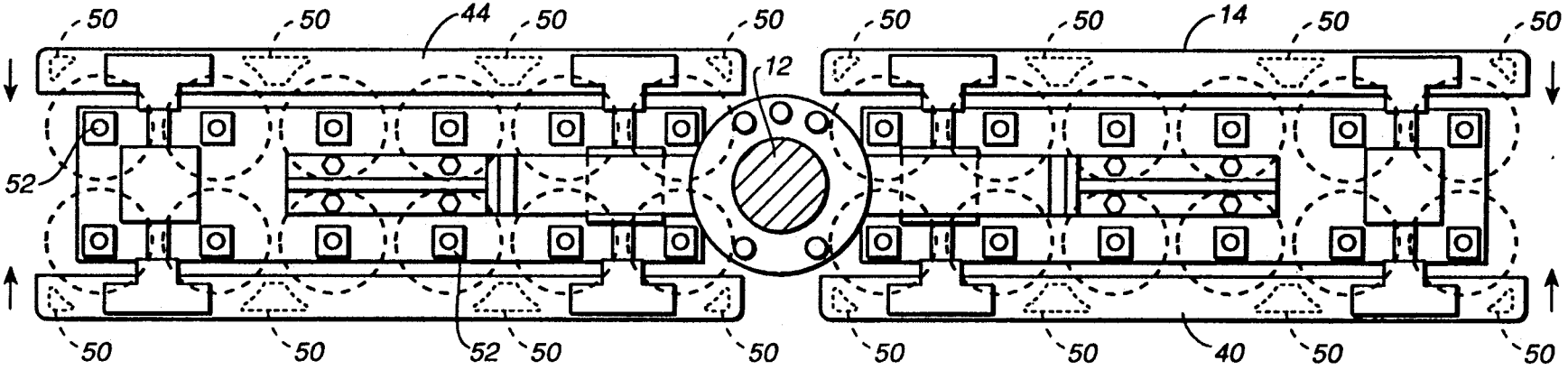
FIG. 3A is a top plan view of article engaging means constructed in accordance with the present invention and illustrating clamping elements thereof in the positions assumed when not clamping articles.
Figure 3B:
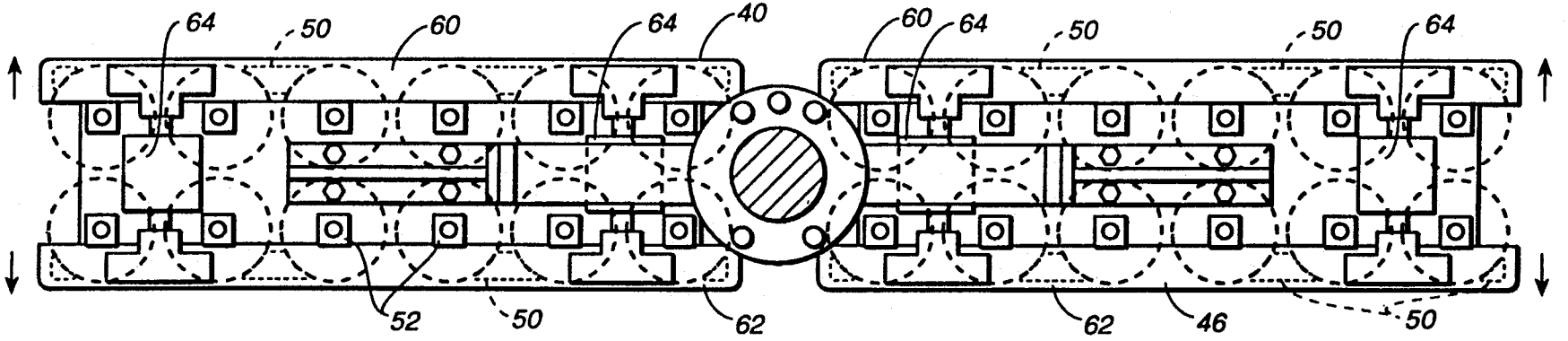
FIG. 3B is a view similar to FIG. 3A, but illustrating the clamping elements in clamping position relative to the articles.

FIG. 2A illustrates the condition of three containers 24 which have been positioned at the work station. It will be noted that two of the containers, the left and center cartons, contain cups 32 all of one color, the colors differing between containers. The container at the right end of the line of containers as shown in FIG. 2A, however, has two rows of cups 32 of one color and two rows of cups of another color, both of the colors differing from the colors of the cups in the two containers having uniform colors.

The article engaging means and the left and center containers at the mixing station are now brought into partial registry, as illustrated by the dash line designating the article engaging means. The article engaging means spans both containers, with a fixture section over each. Two rows of cup stacks are removed from the center and left containers and the robot arm causes the article engaging means to make a 180 degree turn (as shown by the arrow) so that the two rows from one container are inserted into the other of the two containers and vice versa. That is, the inserted rows take up the spaces of the removed rows. This will result in the situation shown in FIG. 2B wherein the left and center containers each contain cups of two colors, two rows of each.

Now the containers and article engaging means are relatively positioned as shown in FIG. 2C. That is, the article engaging means 14 is in registry with the two innermost rows of cups of the center container and the container on the right. These rows are switched between these two containers as shown by the arrow. This results in the middle container and the right container being filled with four rows of cups, each row being of a different color. The center and right containers are then off loaded from feed conveyor 30 as shown in FIG. 1, closed, and moved to another location for storage or shipment.

The formerly left container 24 now is moved by the conveyor 30 so that it is the right container at the mixing station, and two additional containers 24, each of which contains cups of solid color, are then moved into the center and left positions at the mixing station as shown in FIG. 2D. The process described above is then repeated.

Figure 5B:
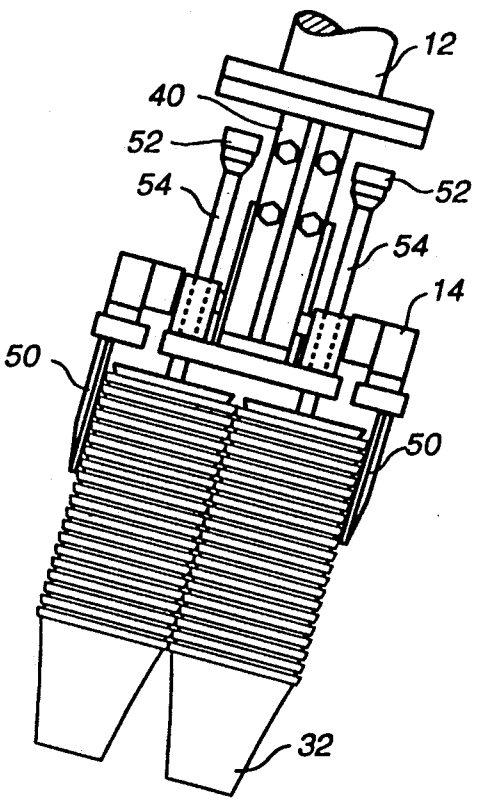
FIG. 5B is a view similar to FIG. 5A but illustrating the article engaging means with the clamping elements thereof clamping the stacked cups.
Figure 5A:
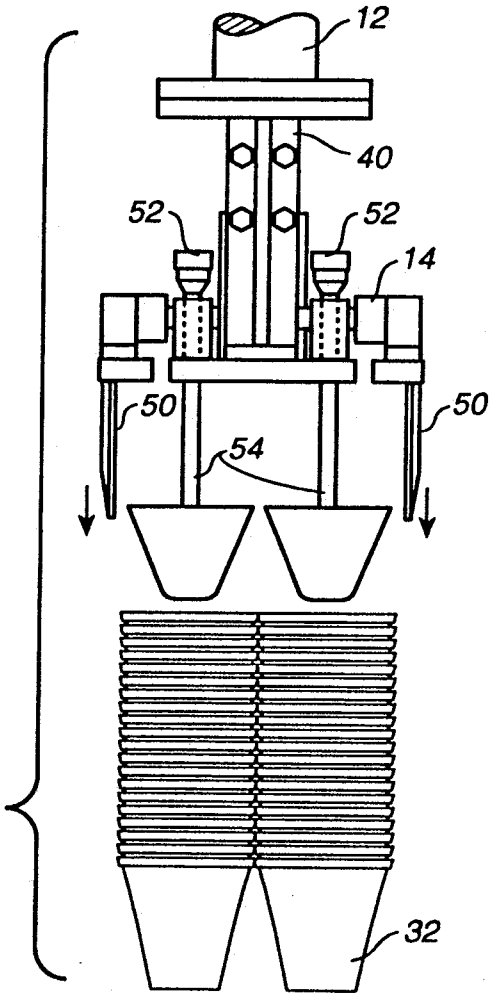
FIG. 5A is a partial, side, elevational view of the article engaging means prior to engagement with stacks of cups.

Insertion of cups into the desired containers is accomplished simply by lowering the article engaging means 14 and cups attached thereto until the cups are positioned in the desired locations (the vacated row spaces) in the interior of the containers. The clamping elements are subsequently moved to their non-clamping positions and then the article engaging means is raised by the robot. The weight of the follower elements 52 exerts a bias on the cup stacks which will ensure clean separation between the clamping elements and stacks. It has been found that entry of cup stacks into a container is facilitated if the container interior is approached at an angle by the article engaging means as shown in FIG. 5B. This will serve to nudge apart the rows of cups already occupying the interior to create room for the rows of stacked cups being inserted.

I claim:

1. Apparatus for transferring articles between a first location and a second location, said apparatus comprising, in combination:

robot means including a movable robotic arm; and article engaging means operatively associated with said movable robotic arm and movable therewith for engaging a plurality of articles and transferring the plurality of articles from a first location to a second location, said article engaging means including a fixture attached to said movable robotic arm and movable therewith, a plurality of clamping elements movably connected to said fixture to selectively clamp articles, means for moving said clamping elements relative to said fixture between a clamping position and a non-clamping position, and means for biasing articles clamped by said clamping elements in a direction away from said clamping elements to urge said biased articles out of engagement with said clamping elements when said clamping elements are moved from said clamping position to said non-clamping position by said means for moving said clamping elements, said means for biasing said articles including a plurality of follower elements engageable with said articles, said follower elements being mounted for slidable movement relative to said fixture and operable under the influence of gravity to bias articles clamped by said clamping elements in a direction away from said fixture.

2. The apparatus according to claim 1 wherein said articles are stacks of cups, each said follower element including a tapered follower head positionable in a stack of cups, said tapered follower heads being cooperable with said stacks of cups to move said stacks of cups to predetermined positions relative to said clamping elements.

* * * * *